US008126341B2

(12) United States Patent
Mohri

(10) Patent No.: US 8,126,341 B2
(45) Date of Patent: Feb. 28, 2012

(54) IMAGE FORMING APPARATUS WITH A COUNTING UNIT

(75) Inventor: Kazuo Mohri, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 740 days.

(21) Appl. No.: 12/243,034

(22) Filed: Oct. 1, 2008

(65) Prior Publication Data

US 2009/0116859 A1 May 7, 2009

(30) Foreign Application Priority Data

Nov. 5, 2007 (JP) ..... 2007-287248

(51) Int. Cl.
*G03G 15/00* (2006.01)
*G03G 21/00* (2006.01)

(52) U.S. Cl. ..... 399/43; 399/44; 399/92

(58) Field of Classification Search ..... 399/43, 399/44, 75, 92, 159, 167
See application file for complete search history.

(56) References Cited

U.S. PATENT DOCUMENTS 4,806,968 A * 2/1989 Watanabe et al. ..... 399/92
5,532,791 A * 7/1996 Takahashi et al. ..... 399/43 X
5,832,332 A * 11/1998 Sugiura ..... 399/44
6,219,496 B1 * 4/2001 Kojima et al. ..... 399/43
2006/0197825 A1 9/2006 Mohri
2008/0166165 A1 7/2008 Mohri ..... 399/397

FOREIGN PATENT DOCUMENTS

| | | |
|---|---|---|
| JP | 58-116544 | 7/1983 |
| JP | 1-172853 | 7/1989 |
| JP | 5-241405 | 9/1993 |
| JP | 7-128919 | 5/1995 |
| JP | 2003-43757 | 2/2003 |

OTHER PUBLICATIONS

Machine translation of JP 07-128919 A dated Jul. 5, 2011.*

* cited by examiner

*Primary Examiner* — Sophia S Chen
(74) *Attorney, Agent, or Firm* — Oblon, Spivak, McClelland, Maier & Neustadt, L.L.P.

(57) ABSTRACT

An image forming apparatus includes a counting unit that, when a driving unit for rotating an image carrier is operating, adds a predetermined first count value to a total count value in a predetermined timing and that, when the driving unit is being stopped, subtracts a predetermined second count value from the total count value in every predetermined timing; and a suspending unit that suspends printing when the total count value becomes equal to or larger than a preset suspend value.

15 Claims, 9 Drawing Sheets

IMAGE FORMING APPARATUS WITH A COUNTING UNIT

CROSS-REFERENCE TO RELATED APPLICATIONS

The present application claims priority to and incorporates by reference the entire contents of Japanese priority document 2007-287248 filed in Japan on Nov. 5, 2007.

BACKGROUND OF THE INVENTION

1. Field of the Invention

The present invention relates to an image forming apparatus such as a facsimile, a printer, a copier, and a multifunction peripheral.

2. Description of the Related Art

Image forming apparatuses such as a facsimile, a printer, a copier, and a multifunction peripheral perform a sequence of image forming operations in the following manner. A photosensitive element (which is uniformly charged in advance by a charging unit) as an image carrier that rotates in a sub scanning direction is exposed by an exposing unit in response to an original image or image data to form an electrostatic latent image. Toner is adhered to the latent image by a developing unit to form a toner image. The toner image is transferred by a transfer unit onto a sheet as a recording medium. The toner image on the sheet is then fixed thereto by heat and pressure by a fixing unit including a fixing roller with a built-in heater and a pressing roller.

It is known that, in such an image forming apparatus, the condition of the surface of the photosensitive element or image formation is changed due to an increase in temperature of the photosensitive element surface, which leads to an image defect.

The increase in temperature of the photosensitive element surface is caused by friction between the photosensitive element and a developing roller or the transfer unit near the photosensitive element, frictional heat produced by rotation of the relevant rollers, or heat from the fixing unit.

The image defect caused by the increase in temperature of the photosensitive element surface is due to a scratch on the photosensitive element surface when the photosensitive element surface has a temperature higher than a predetermined temperature.

When the photosensitive element surface is scratched, the development cannot be performed thereafter on the scratched portion. Accordingly, printing onto a recording sheet (also referred to as "paper", "recording medium", or "printing material") produces faulty images with image quality of a part of an image at a position corresponding to the scratched portion degraded.

The degrees of the increase in temperature of the photosensitive element surface are different in a case in which no recording sheet is passed through like in a warm-up operation, and in cases of single-side printing and duplex printing. This is because air flows in different directions in these cases due to the configuration inside the image forming apparatus (interior configuration). Accordingly, timings of occurrence of the image defect are not uniform.

The speed at which the temperature of the photosensitive element surface increases becomes higher in order of the warm-up operation, the single-side printing, and the duplex printing. The speed at which the temperature of the heated photosensitive element surface cools down becomes higher in the reverse order.

This is because the recording sheet that is being subjected to printing blocks an outlet of air in the apparatus, so that heat stays in the apparatus.

In the case of duplex printing, because images are printed on both sides of a recording sheet through two conveying paths in the apparatus, heat is particularly prone to stay in the apparatus, and thus the temperature of the photosensitive element surface increases more quickly.

To overcome the image defect, a technique is applied that enables to measure the temperature of the photosensitive element surface, and execute or stop printing according to the temperature condition, thereby preventing the problem from occurring.

FIG. 10 is a graph representing a change in temperature of the surface of the photosensitive element in the image forming apparatus during printing. In this example, duplex printing is continuously performed. In FIG. 10, an image error occurs (with high possibility) when the surface has a temperature equal to or higher than a temperature indicated by a dashed line (for example, 44° C.).

When continuous printing is performed and the photosensitive element is continuously operated for a time period $\alpha$ (about 55 minutes) in FIG. 10 at 28° C., which is a room temperature within a range in which the image forming apparatus can form appropriate images (corresponding to the temperature outside of the image forming apparatus), the surface temperature reaches the temperature (44° C.) at which the image defect occurs. In this case, the printing is performed when the temperature of the photosensitive element surface is lower than 44° C., and the printing is stopped when the temperature is equal to or higher than 44° C.

Some conventional image forming apparatuses measure the temperature of the photosensitive element surface or the fixing temperature, and enable printing based on the measurement result (for example, see Japanese Patent Application Laid-open No. H05-241405, Japanese Patent Application Laid-open No. H01-172853, and Japanese Patent Application Laid-open No. S58-116544).

According to these image forming apparatuses, the condition of the temperature of the photosensitive element surface can be reflected on the printing status as mentioned above, and thus the image defect can be easily overcome.

However, these conventional image forming apparatuses need a sensor for measuring the temperature (hereinafter, "temperature sensor"). Therefore, manufacturing costs of the image forming apparatuses are increased, and a space to install the temperature sensor needs to be reserved.

In regard to the space to install the temperature sensor, an image forming apparatus utilizes a measurement temperature of another member abutting the photosensitive element, instead of the temperature of the photosensitive element surface (for example, see Japanese Patent Application Laid-open No. 2003-043757), or an image forming apparatus uses a noncontact temperature sensor (thermopile).

However, any of these conventional image forming apparatuses needs the temperature sensor as ever, which causes the increase in the manufacturing cost of the image forming apparatus.

When the temperature sensor is used, the detected temperature can frequently have a value around 44° C. after a lapse of the driving time $\alpha$ ($\alpha$ is about 55 minutes) of the photosensitive element in the case of the room temperature of 28° C., for example, depending on detection accuracy of the temperature sensor, because the temperature of the photosensitive element surface near 44° C. is near a threshold for the image defect region, as shown in FIG. 10. Therefore, a printing operation is often suspended, which is inconvenient for the user.

There is a technique that enables to set a printable (start) temperature lower than a suspend temperature, thereby reducing the number of time of the suspend operations. For example, a case in which the printable temperature is set to a temperature that is 1° C. lower than the suspend temperature (44° C.) is examined. The driving of the photosensitive element needs to be stopped for about 10 minutes as indicated by γ in FIG. 11, to lower the temperature of the photosensitive element surface by 1° C. from 44° C. to 43° C. as indicated by β in FIG. 11; meanwhile, the printing operation is suspended, and it is inconvenient for the user.

SUMMARY OF THE INVENTION

It is an object of the present invention to at least partially solve the problems in the conventional technology.

According to an aspect of the present invention, there is provided an image forming apparatus that forms an image on a recording medium by forming a latent image on an image carrier driven to rotate by a driving unit, developing the latent image into a toner image with toner, and fixing the toner image transferred onto the recording medium by a fixing unit, the image forming apparatus including: a counting unit that, when the driving unit is operating, adds a predetermined first count value to a total count value in a predetermined timing and that, when the driving unit is being stopped, subtracts a predetermined second count value from the total count value in every predetermined timing; and a suspending unit that suspends printing when the total count value becomes equal to or larger than a preset suspend value.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained below in detail with reference to the accompanying drawings.

Figure 1:
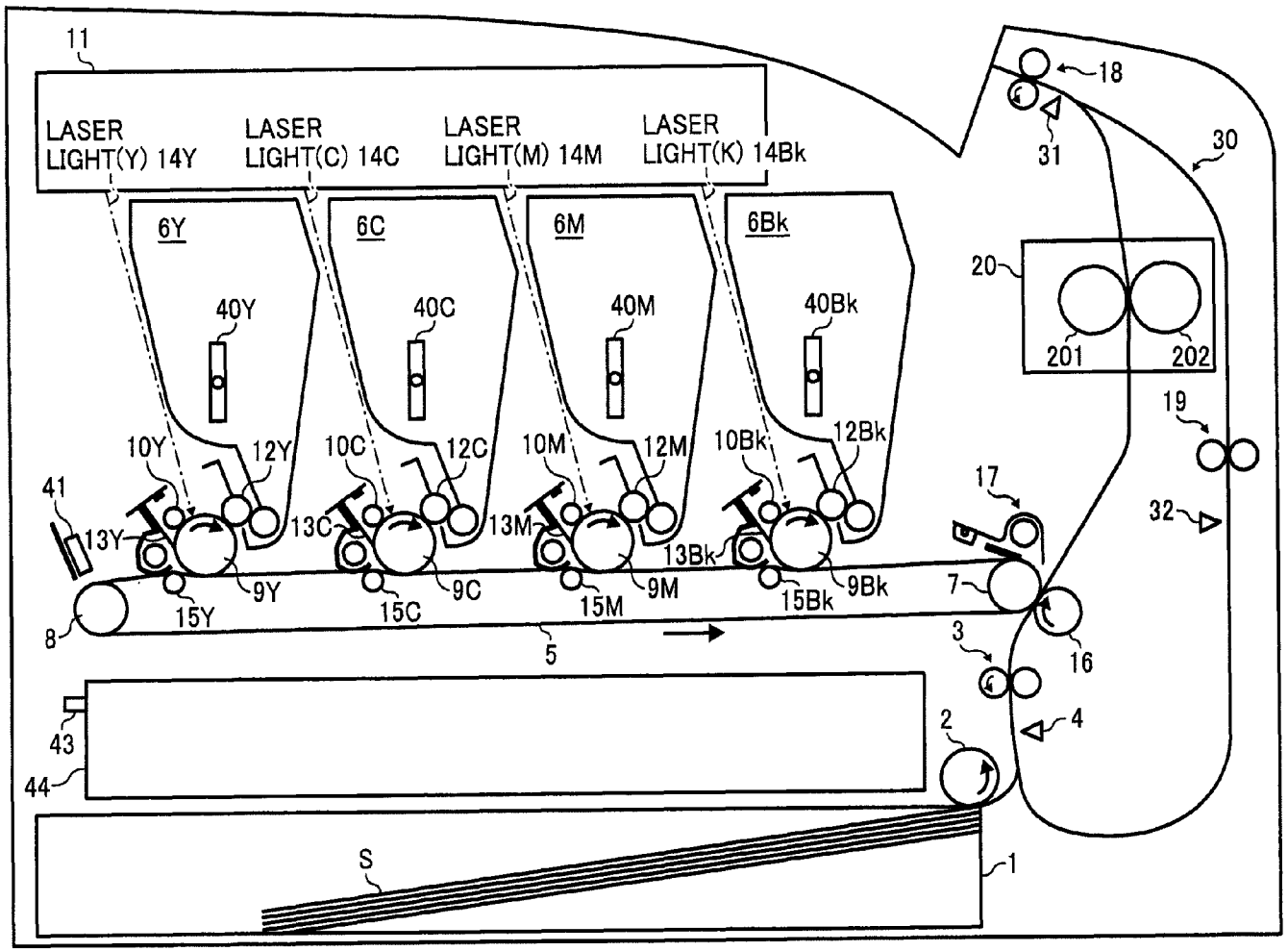
FIG. 1 is a schematic diagram of a mechanical portion of an image forming apparatus according to an embodiment of the present invention.

FIG. 1 is a schematic diagram of a mechanical portion of an image forming apparatus according to an embodiment of the present invention.

The image forming apparatus includes all-in-one (AIO) cartridges 6Bk, 6M, 6C, and 6Y as electrophotographic processing units (image forming units) of a plurality of colors, which are arranged along a transfer belt 5 corresponding to a transfer unit, as shown in FIG. 1. This image forming apparatus is a so-called "tandem type".

The transfer belt 5 rotates in a direction indicated by an arrow (counterclockwise). The AIO cartridges 6Bk, 6M, 6C, and 6Y are arranged in this order from upstream of the rotation direction of the transfer belt 5.

The AIO cartridges 6Bk, 6M, 6C, and 6Y have the same internal configuration, and only the difference among them is that they form different colors of toner images.

The AIO cartridge 6Bk forms black toner images, the AIO cartridge 6M forms magenta toner images, the AIO cartridge 6C forms cyan toner images, and the AIO cartridge 6Y forms yellow toner images.

The AIO cartridges 6Bk, 6M, 6C, and 6Y include paddles 40Bk, 40M, 40C, and 40Y that agitate toner inside thereof, respectively.

The AIO cartridge 6Bk is specifically described in the following explanation. The other AIO cartridges 6M, 6C, and 6Y are similar to the AIO cartridge 6Bk. Therefore, constituent elements of the AIO cartridges 6M, 6C, and 6Y are merely denoted by references having M, C, and Y instead of Bk, which is attached to the constituent elements of the AIO cartridge 6Bk in FIG. 1, respectively, and thus explanations of the AIO cartridges 6M, 6C, and 6Y are omitted.

The transfer belt 5 is an endless belt supported by a secondary-transfer driving roller 7 and a transfer-belt support roller 8 that are rotationally driven.

The secondary-transfer driving roller 7 is rotationally driven by a driving motor as a driving source (not shown). The driving motor, the secondary-transfer driving roller 7, and the transfer-belt support roller 8 serve as a driving unit that moves the transfer belt 5.

The AIO cartridge 6Bk includes a photosensitive element 9Bk, a charging unit 10Bk placed near the photosensitive element 9Bk, an exposing unit 11, a developing unit 12Bk, a cleaning blade 13Bk, and the like.

The exposing unit 11 applies laser light 14Bk, 14M, 14C, and 14Y as exposure light corresponding to image colors formed by the AIO cartridges 6Bk, 6M, 6C, and 6Y, respectively.

In image formation, an outer circumferential surface of the photosensitive element 9Bk is uniformly charged by the charging unit 10Bk in the dark, and then exposed to the laser light 14Bk corresponding to a black image by the exposing unit 11, thereby forming an electrostatic latent image.

The developing unit 12Bk develops the electrostatic latent image using black toner, so that a black toner image is formed on the photosensitive element 9Bk.

The toner image is transferred onto the transfer belt 5 by an action of a primary transfer roller 15Bk at a position where the photosensitive element 9Bk and the transfer belt 5 are in contact with each other (primary transfer position).

The transfer forms an image with black toner on the transfer belt 5.

Unnecessary toner remaining on the outer circumferential surface on the photosensitive element 9Bk that has subjected to the transfer of the toner image is removed by the cleaning blade 13Bk, and then the cleaned photosensitive element 9Bk stands by for the next image formation.

The transfer belt 5 having the black toner image transferred with the AIO cartridge 6Bk is conveyed to the next AIO cartridge 6M.

At the AIO cartridge 6M, a magenta toner image is formed on the photosensitive element 9M by the same process as the image forming process performed by the AIO cartridge 6Bk, and the magenta toner image is superimposedly transferred onto the black image formed on the transfer belt 5.

The transfer belt 5 is sequentially conveyed to the subsequent AIO cartridges 6C and 6Y, and a cyan toner image formed on the photosensitive element 9C and a yellow toner image formed on the photosensitive element 9Y in the same operation are superimposedly transferred onto the transfer belt 5. In this way, a full-color image is formed on the transfer belt 5.

The transfer belt 5 having the full-color superimposed image formed thereon is conveyed up to the position of a secondary transfer roller 16.

When only a black image is to be formed during the image formation, primary transfer rollers 15M, 15C, and 15Y are retracted to positions spaced apart from the photosensitive elements 9M, 9C, and 9Y, respectively, so that the image forming process mentioned above is performed only for the black color.

With respect to a sheet conveying operation during the image formation, a feed roller 2 is driven to rotate in a direction indicated by an arrow (counterclockwise) to send out sheets S accommodated in a feed tray 1 one by one from the top. The sheet S sent out is stopped according to a position of a registration roller 3, and kept waiting. The sheet S is stopped predetermined time after the head of the sheet S is sensed (detected) by a registration sensor 4.

Driving of the registration roller 3 is started at a timing when the toner image carried by the transfer belt 5 and the sheet S are overlapped on the secondary transfer roller 16. At that time, the registration roller 3 sends out the sheet S by driving it to rotate in the direction indicated by the arrow (counterclockwise).

The toner image on the transfer belt 5 is transferred by the secondary transfer roller 16 onto the sheet S sent out by the registration roller 3. The toner image transferred on the sheet S is then fixed thereto by a fixing unit 20 with heat and pressure. The sheet S is then ejected (discharged) out of the image forming apparatus by driving a discharging roller 18 to rotate in a direction indicated by an arrow (counterclockwise).

The fixing unit 20 includes a fixing roller 201 and a pressing roller 202. The fixing roller 201 has an aluminum cored bar with rubber coated thereon, and includes a built-in heater.

The pressing roller 202 has the same configuration having an aluminum cored bar with rubber coated thereon. The pressing roller 202 is in contact with the fixing roller 201 at a predetermined pressure (hereinafter, this contact portion is referred to as "nip portion").

The fixing roller 201 is driven to rotate by a driving system (driving unit) (not shown), and accordingly the pressing roller 202 in contact with the fixing roller 201 also rotates. The toner image secondarily transferred onto the sheet S is fixed on the sheet S with heat and pressure while the sheet S is passing between these two rollers.

Unnecessary toner remaining on the outer circumferential surface of the transfer belt 5 that has completed the transfer of the toner image is removed by a belt cleaner 17. The cleaned transfer belt 5 is then kept waiting for the next image formation.

In a duplex printing mode in which images are formed both on the front and back sides of the sheet S, the discharging roller 18 is driven to rotate clockwise before the sheet S passes through the discharging roller 18 (at a point of time when the sheet S is no longer detected by a discharge sensor 31), thereby conveying the sheet S to a duplex conveying path 30.

The sheet S conveyed to the duplex conveying path 30 passes through duplex rollers 19, is detected by a duplex sensor 32, and then conveyed up to the registration roller 3 again.

The sheet S having reached the registration roller 3 is re-fed through the registration roller 3. A toner image is then transferred onto the opposite side of the sheet S by the secondary transfer roller 16, then fixed by the fixing unit 20 with heat and pressure, and discharged out of the image forming apparatus through the discharging roller 18 that is rotationally driven in the direction indicated by the arrow.

In this way, an electrostatic latent image of an image is formed on the photosensitive element as an image carrier that is rotationally driven by the driving motor as a driving unit (not shown), and toner is adhered to the electrostatic latent image to form a toner image. The toner image is transferred onto a sheet, which is fixed on the sheet, thereby printing an image on the sheet.

Reference numeral 41 denotes a toner mark (TM) sensor. The removed toner is held in a waste toner box 44. A waste-toner full-detecting sensor 43 is a detecting unit that detects that the waste toner box 44 is full of waste toner.

Figure 2:
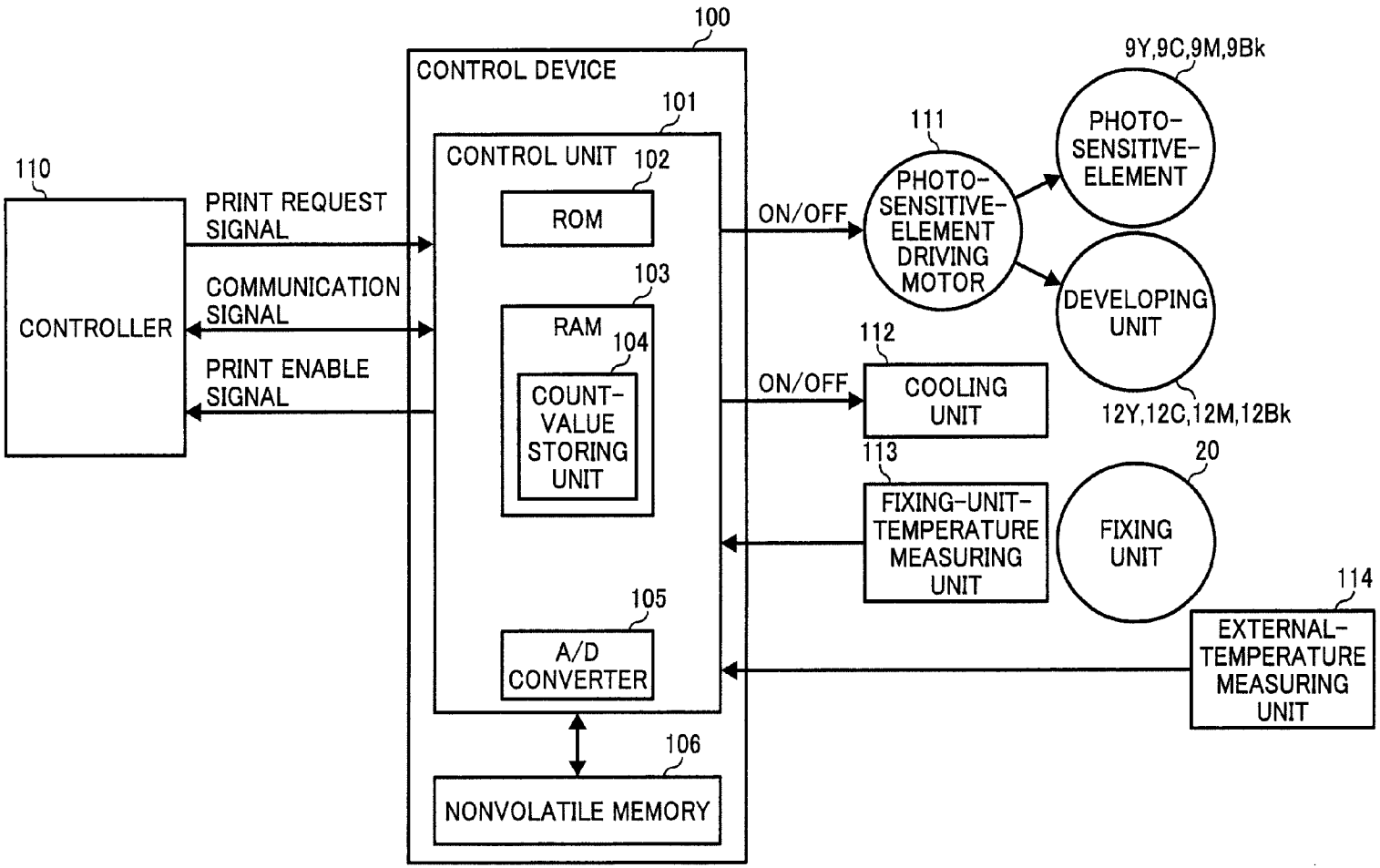
FIG. 2 is a block diagram of a functional configuration of a control section of the image forming apparatus.

FIG. 2 is a block diagram of a functional configuration of mainly a control section of the image forming apparatus according to the present embodiment.

A control device 100 includes a control unit 101 as a central processing unit (CPU), and a nonvolatile memory 106 corresponding to a nonvolatile storage unit. The control unit 101 is an arithmetic and control unit that controls functions of the image forming apparatus, including operations according to the present invention. That is, the control unit 101 serves as various units including a counting unit, a suspending unit, and a resuming unit according to the present invention.

The control unit 101 includes a read only memory (ROM) 102, a random access memory (RAM) 103, and an analog/digital (A/D) converter 105.

The ROM 102 is a fixed storage that stores therein programs executed by the control unit 101, and the like.

The RAM 103 is a main storage that is used when the control unit 101 performs various control processes, and includes a count-value storing unit 104.

The count-value storing unit 104 constitutes a part of storage capacity of the RAM 103, and is an area in which the control unit 101 stores a total of count values that are to be added or subtracted according to operating conditions of a photosensitive-element driving motor 111.

The A/D converter 105 is incorporated in the control unit 101, and converts temperatures measured by a fixing-unit-temperature measuring unit 113 and an external-temperature measuring unit 114 into digital values.

A controller 110 issues a print instruction to the control unit 101, or causes the control unit 101 to perform image processing. A print request signal output from the controller 110 to the control unit 101 is used to instruct the control unit 101 to perform printing. The print request signal is ensured to be turned on and off once at each printing of a sheet.

A communication signal is used to establish communications between the controller 110 and the control unit 101. The controller 110 serves as a protocol that always informs the control unit 101 of the single-side printing or the duplex printing using a communication signal before the print request signal is turned on.

A print enable signal is used by the control unit 101 to transmit to the controller 110 "1" when the image forming apparatus is in a printable status, and "0" when the image forming apparatus is in an unprintable status.

The nonvolatile memory 106 stores therein a total of the count values stored in the count-value storing unit 104.

The photosensitive-element driving motor 111 drives the photosensitive elements 9Bk, 9M, 9C, and 9Y to rotate. When the control unit 101 executes a computer program in the ROM 102 to instruct an operation of switching ON or OFF the photosensitive-element driving motor 111 in a timing required for a printing or warm-up operation, the photosensitive-element driving motor 111 is rotated or stopped in response to the operation instruction.

When the photosensitive-element driving motor 111 receives an ON instruction from the control unit 101, the photosensitive-element driving motor 111 operates, so that drive force is transmitted to the photosensitive elements 9Bk, 9M, 9C, and 9Y, and the developing units 12Bk, 12M, 12C, and 12Y through a mechanism.

When the photosensitive-element driving motor 111 receives an OFF instruction from the control unit 101, the photosensitive-element driving motor 111 stops the rotational operation, so that driving of the photosensitive elements 9Bk, 9M, 9C, and 9Y, and the developing units 12Bk, 12M, 12C, and 12Y is stopped.

While the photosensitive-element driving motor 111 is operating, friction heat is produced between the photosensitive elements 9Bk, 9M, 9C, and 9Y and the corresponding developing units 12Bk, 12M, 12C, and 12Y. Accordingly, the temperatures of the photosensitive element surfaces increase.

A cooling unit 112 is a fan motor that is driven according to an operation instruction from the control unit 101, to reduce the heat in the image forming apparatus. In the present embodiment, a fan motor is used as an air cooling unit; however, any other cooling unit can be applied.

Upon receipt of an ON instruction from the control unit 101, the cooling unit 112 starts rotating, and circulates heat staying in the apparatus or discharges the heat outside the apparatus, thereby cooling the image forming apparatus.

The fixing-unit-temperature measuring unit 113 (fixing-unit-temperature detecting unit) includes a thermistor for measuring the temperature of the fixing unit 20 (the temperature of the surface of the fixing roller (not shown)). The fixing-unit-temperature measuring unit 113 constantly measures the temperature during operations of the control unit 101.

The external-temperature measuring unit 114 is attached to the housing of the image forming apparatus. The external-temperature measuring unit 114 is a temperature sensor corresponding to a temperature measuring unit that measures the temperature outside the apparatus.

A print control process performed by the image forming apparatus according to the present embodiment is explained.

Figure 3:
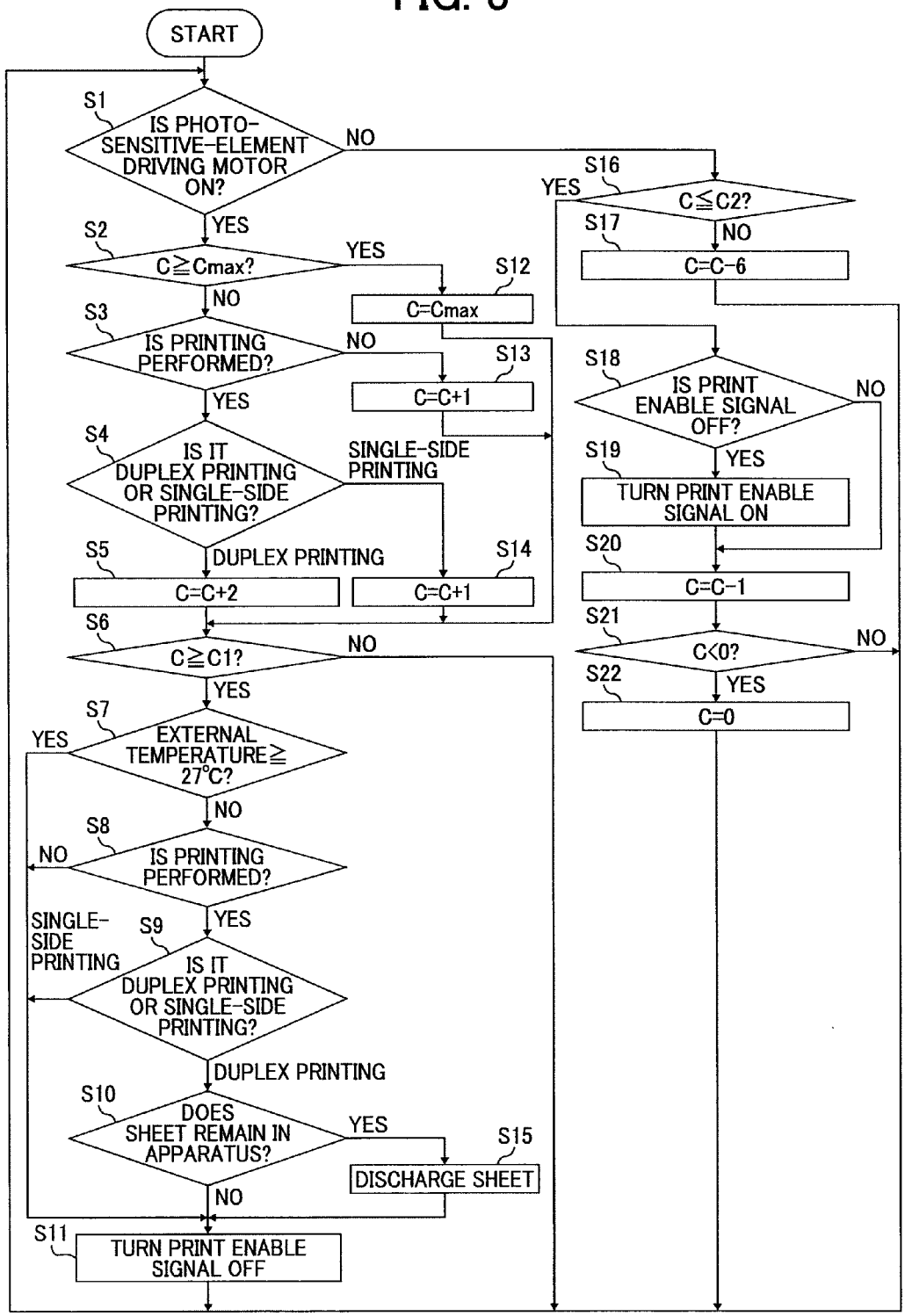
FIG. 3 is a flowchart of a print control process performed by a control unit of the image forming apparatus.

FIG. 3 is a flowchart of a print control process performed by the control unit 101 of the image forming apparatus according to the present embodiment.

A control operation performed by the control unit 101 is started every second, for example, during the operation of the image forming apparatus.

At Step S1, it is determined whether the photosensitive-element driving motor 111 is ON (operating). When the photosensitive-element driving motor 111 is ON (operating), the system control proceeds to Step S2. When the photosensitive-element driving motor 111 is OFF (being stopped), the system control proceeds to Step S16.

At Step S2, it is determined whether a total count value C stored in the count-value storing unit 104 is equal to or higher than a preset count upper limit Cmax (=2500). When a relation of C≧Cmax is not satisfied, that is, when C<Cmax, the system control proceeds to Step S3. When C≧Cmax, the system control proceeds to Step S12.

At Step S12, because the total count value C is equal to or higher than the count upper limit Cmax (=2500), the total count value C is updated with the count upper limit Cmax (2500), and then the system control proceeds to Step S6.

In this way, by defining the count upper limit Cmax, addition of the count value is performed such that the total count value C does not exceed the count upper limit Cmax.

At Step S3, it is determined whether printing is currently performed. The system control proceeds to Step S4 when the printing is currently performed, and otherwise proceeds to Step S13.

At Step S13, "1" is added to the total count value C, corresponding to an operation other than the printing, resulting in C=C+1, and then the system control proceeds to Step S6.

The count value to be added (addition value) to the total count value C can be set at different values for a time of printing and a time other than the time of printing.

At Step S4, it is determined whether the printing is performed in the duplex printing mode or the single-side printing mode. The system control proceeds to Step S5 in the duplex printing mode, while the system control proceeds to Step S14 in the single-side printing mode.

At Step S5, "2" is added to the total count value C, corresponding to the duplex printing, resulting in C=C+2, and then the system control proceeds to Step S6.

At Step S14, "1" is added to the total count value C, corresponding to the single-side printing, resulting in C=C+1, and then the system control proceeds to Step S6.

In this way, the predetermined count value (addition value) to be added to the total count value C is set at different values for the single-side printing and the duplex printing.

At Step S6, it is determined whether the total count value C is equal to or larger than a print disable threshold C1 (=2400) corresponding to a preset suspend threshold. When C≧C1, the system control proceeds to Step S7. When C<C1, the system control returns to Step S1.

At Step S7, it is determined whether an ambient temperature as the external temperature outside the image forming apparatus, which is measured by the external-temperature measuring unit 114, is equal to or higher than 27° C. The system control proceeds to Step S8 when the ambient temperature is lower than 27° C., while the system control proceeds to Step S11 when the ambient temperature is equal to or higher than 27° C.

At Step S11, a print enable signal to the controller 110 is turned off, and then the system control returns to Step S1.

In this way, when the temperature outside the image forming apparatus becomes equal to or higher than a preset temperature of 27° C., image print is suspended.

At Step S8, it is determined whether the printing is currently performed. The system control proceeds to Step S9 when the printing is currently performed, while the system control proceeds to Step S11 when the printing is not performed.

At Step S11, the print enable signal to the controller 110 is turned off, and then the system control returns to Step S1.

At Step S9, it is determined whether the printing is performed in the duplex printing mode or the single-side printing mode. The system control proceeds to Step S10 in the duplex printing mode, while the system control proceeds to Step S11 in the single-side printing mode.

At Step S11, the print enable signal to the controller 110 is turned off, and then the system control returns to Step S1.

At Step S10, it is determined whether sheets that are now subjected to the printing remain in the apparatus (image forming apparatus). The system control proceeds to Step S11 when no sheet remains, while the system control proceeds to Step S15 when any sheet remains.

At Step S15, the sheets in the apparatus are discharged, and then the system control proceeds to Step S11.

At Step S11, the print enable signal to the controller 110 is turned off, and then the system control returns to Step S1.

In this way, image print is suspended when the total count value C becomes equal to or higher than the preset suspend threshold.

When the printing is to be suspended during continuous duplex printing, sheets in the apparatus are discharged out of the apparatus before the suspension of the printing.

In the process above mentioned, when the print enable signal is turned off, the controller 110 suspends the printing.

On the other hand, at Step S16, it is determined whether the total count value C is equal to or lower than a print enable threshold C2 (=2040) corresponding to a preset resume threshold. The system control proceeds to Step S18 when C≦C2. When C>C2, the system control proceeds to Step S17.

At Step S17, a predetermined count value of "6" is subtracted from the total count value C, corresponding to a time when the photosensitive-element driving motor 111 is being stopped, resulting in C=C−6, and then the system control returns to Step S1.

In this way, a predetermined count value is added in a predetermined timing while the photosensitive-element driving motor 111 is operating, and a predetermined count value (subtraction value) is subtracted from the total count value obtained by the addition in every predetermined timing while the photosensitive-element driving motor 111 is being stopped.

The predetermined count value to be subtracted can be set at different values between for a case where the total count value C is higher than the print enable threshold C2 and a case where the total count value C is equal to lower than the print enable threshold C2.

At Step S18, it is determined whether the print enable signal to the controller 110 is OFF. The system control proceeds to Step S19 when the print enable signal is OFF. When the print enable signal is ON, the system control proceeds to Step S20.

At Step S19, the print enable signal to the controller 110 is turned on, and then the system control proceeds to Step S20.

When the print enable signal is turned on in the process above mentioned, the controller 110 resumes the printing that has been suspended.

At Step S20, "1" is subtracted from the total count value C, and then the system control proceeds to Step S21.

At Step S21, it is determined whether the total count value C is smaller than zero. When C<0, the total count value C is corrected to zero (C=0) at Step S22, and then the system control returns to Step S1. When C≧0, the system control returns to Step S1.

Figure 4:
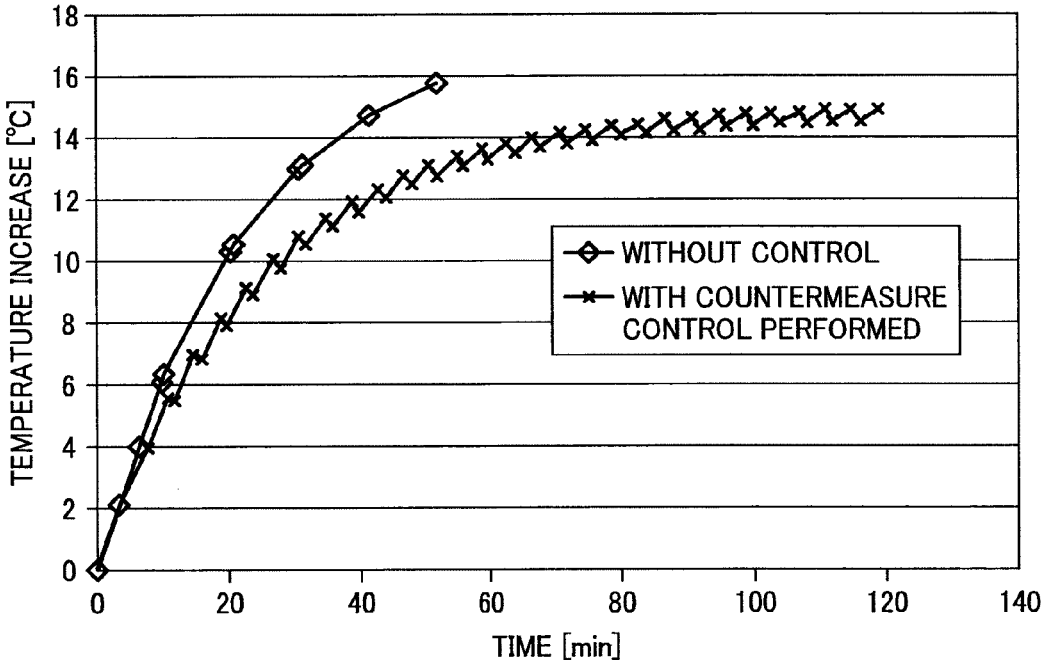
FIG. 4 is a graph representing a change in temperature of the photosensitive element surface when a print control is performed.

FIG. 4 is a graph representing a change in temperature of the photosensitive element surface when the print control mentioned above is performed.

In FIG. 4, origins of a case that the print control mentioned above is performed and of a case that the print control is not performed are set at the same temperature, that is, 28° C.

Compare a curve obtained when the print control mentioned above is performed (curve of a case that a countermeasure control is performed in FIG. 4) and a curve obtained when the print control is not performed (curve of a case that no control is performed in FIG. 4). The temperature in the case that the countermeasure control is performed increases more slowly than the temperature in the case that no control is performed. Furthermore, the temperature in the case that the countermeasure control is performed reaches an equilibrium state near 43° C. (=28° C.+15° C.). Therefore, even when continuous printing is performed, the temperature will not reach 44° C. (corresponding to a temperature increase K=16 in FIG. 4), at which a failure (defect) can occur in images.

This effect is obtained because the values to be added at Steps S5, S13, and S14 in the print control process mentioned above do not represent actual temperature increases but are set such that more steep inclines than actual are obtained. This effect is obtained also because the temperature of the photosensitive element surface decreases during a print suspension for one minute from when the total count value C reaches the print disable threshold C1 and then the printing is suspended until when the total count value C is decremented down to a value that is equal to or lower than the print enable threshold C2, (2400−6 [subtracted count value]×60 [seconds]=2040).

Figure 5:
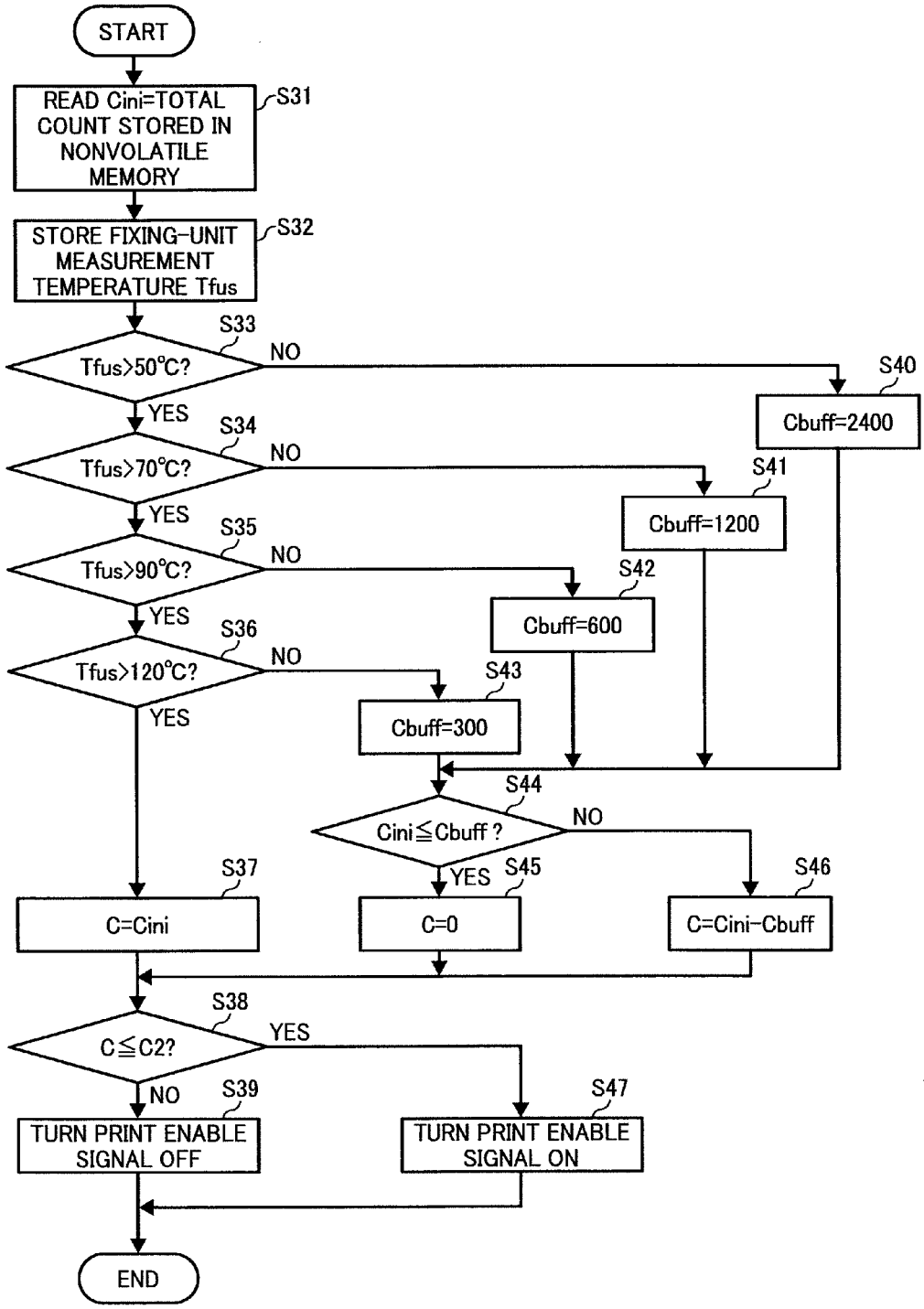
FIG. 5 is a flowchart of another control process performed by the control unit.

FIG. 5 is a flowchart of another control process performed by the control unit 101 of the image forming apparatus according to the present embodiment.

This control process is started once at power-on of the image forming apparatus, and at return from an energy saving mode such as a sleep mode.

At Step S31, the total count value C stored in the nonvolatile memory 106 is read as a counter initial value Cini, and then the system control proceeds to Step S32.

At Step S32, a fixing unit temperature Tfus measured by the fixing-unit-temperature measuring unit 113 is stored in the RAM 103, and then the system control proceeds to Step S33.

At Step S33, it is determined whether the fixing unit temperature Tfus is higher than 50° C. The system control proceeds to Step S34 when the temperature Tfus is higher than 50° C., while the system control proceeds to Step S40 when the temperature Tfus is not higher than 50° C.

At Step S34, it is determined whether the fixing unit temperature Tfus is higher than 70° C. The system control proceeds to Step S35 when the temperature Tfus is higher than 70° C., while the system control proceeds to Step S41 when the temperature Tfus is not higher than 70° C.

At Step S35, it is determined whether the fixing unit temperature Tfus is higher than 90° C. The system control proceeds to Step S36 when the temperature Tfus is higher than 90° C., while the system control proceeds to Step S42 when the temperature Tfus is not higher than 90° C.

At Step S36, it is determined whether the fixing unit temperature Tfus is higher than 120° C. The system control proceeds to Step S37 when the temperature Tfus is higher than 120° C., while the system control proceeds to Step S43 when the temperature Tfus is not higher than 120° C.

At Step S37, the counter initial value Cini is set as the total count value C in the count-value storing unit 104, and then the system control proceeds to Step S38.

At Step S40, a value Cbuff is set to 2400, and then the system control proceeds to Step S44.

At Step S41, the count value Cbuff is set to 1200, and then the system control proceeds to Step S44.

At Step S42, the count value Cbuff is set to 600, and then the system control proceeds to Step S44.

At Step S43, the count value Cbuff is set to 300, and then the system control proceeds to Step S44.

At Step S44, it is determined whether the counter initial value Cini is equal to or lower than the count value Cbuff. The system control proceeds to Step S45 when the counter initial value Cini is equal to or lower than the count value Cbuff. Otherwise, the system control proceeds to Step S46.

At Step S45, the total count value C is set to zero, and then the system control proceeds to Step S38.

At Step S46, the total count value C is set to a difference between the counter initial value Cini and the count value Cbuff, that is, C=Cini−Cbuff, and then the system control proceeds to Step S38.

At Step S38, it is determined whether total count value C is equal to or lower than the print enable threshold C2 (=2040). The system control proceeds to Step S39 when the total count value C is higher than the print enable threshold C2, while the system control proceeds to Step S47 when the total count value C is equal to or lower than the print enable threshold C2.

At Step S39, the print enable signal to the controller 110 is turned off to disable the controller 110 to perform printing, and then the process ends.

At Step S47, the print enable signal to the controller 110 is turned on to enable the controller 110 to perform printing, and then the process ends.

In the processes from Step S33 to Step S36, the condition of the fixing temperature is substituted to determine a time to turn off the power.

Figure 6:
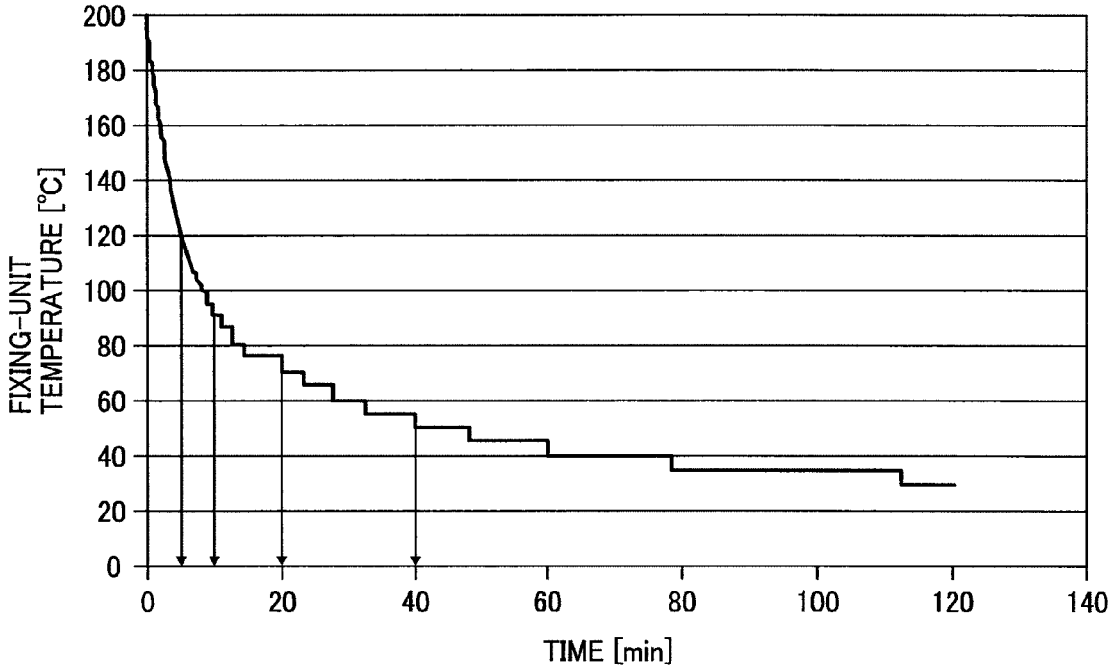
FIG. 6 is a graph representing a change in temperature of a fixing unit of the image forming apparatus after power-off of the image forming apparatus.

FIG. 6 is a graph representing a change in temperature of the fixing unit 20 after power-off of the image forming apparatus according to the present embodiment.

As shown in FIG. 6, the temperature of the fixing unit that is powered on decreases down to 120° C. about 5 minutes after power-off, and decreases down to 90° C. about 10 minutes after the power-off.

The process is performed such that the subtraction values corresponding to these time periods are reflected on the total count value C stored before the power-off.

In this way, the condition of the temperature of the photosensitive element surface can be reproduced even when the image forming apparatus is powered off or on.

Figure 7:
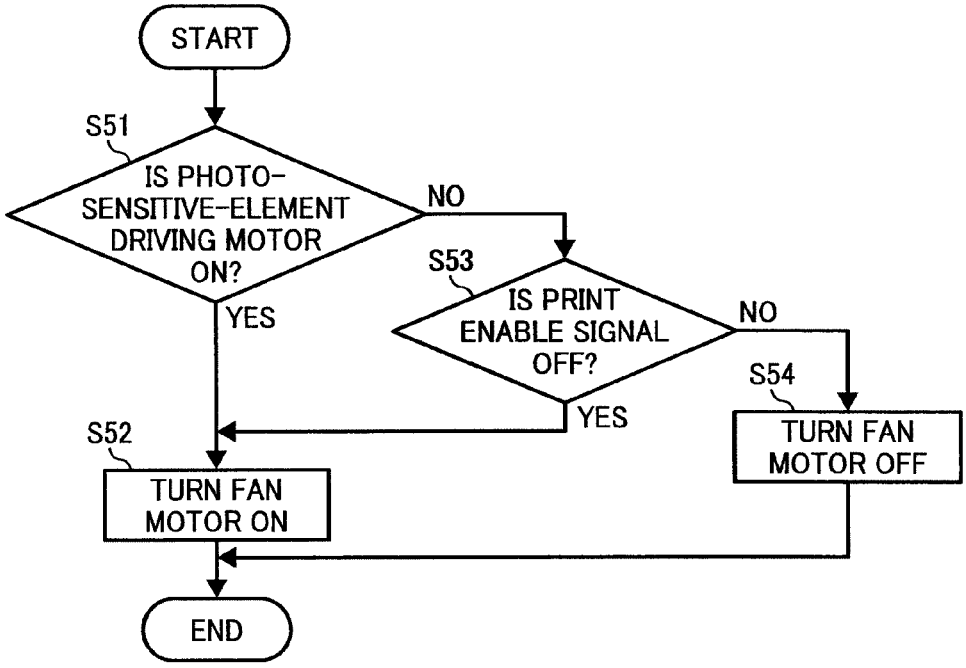
FIG. 7 is a flowchart of a control over a fan motor as a cooling unit of the image forming apparatus.

FIG. 7 is a flowchart of a control over a fan motor as the cooling unit 112 in the image forming apparatus according to the present embodiment.

The control unit 101 starts this control every 5 milliseconds, for example, after the image forming apparatus is powered on.

At Step S51, it is determined whether the photosensitive-element driving motor 111 is powered on. The control proceeds to Step S52 when the photosensitive-element driving motor 111 is powered on. When the photosensitive-element driving motor 111 is powered off, the system control proceeds to Step S53.

At Step S53, it is determined whether the print enable signal is OFF. The system control proceeds to Step S52 when the print enable signal is OFF. When the signal is ON, the system control proceeds to Step S54.

At Step S52, the fan motor as the cooling unit 112 is turned on to suppress increases in the temperature of the entire image forming apparatus when the photosensitive-element driving motor 111 is powered on, and to lower the temperature of the photosensitive element surface when the print enable signal is OFF, and then the control ends.

At Step S54, the fan motor as the cooling unit 112 is turned off when the photosensitive-element driving motor 111 is powered off and the print enable signal is ON, and then the control ends.

Figure 8:
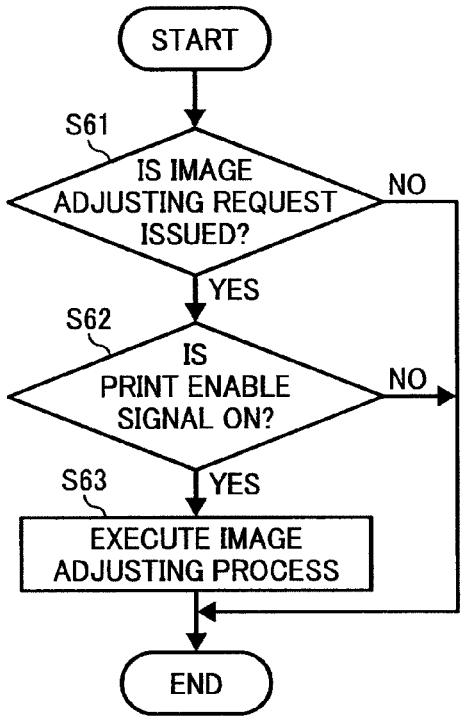
FIG. 8 is a flowchart of a control of an image adjusting process performed by the image forming apparatus.

FIG. 8 is a flowchart of a control of an image adjusting process performed by the image forming apparatus according to the present embodiment.

When the image adjusting process is performed while the surface of the photosensitive element in the image forming apparatus has a high temperature, the images are distorted like during printing.

As a result, the image adjustment may not be performed correctly. Thus, the control needs to be performed such that the adjusting process is not performed when the photosensitive element surface has a high temperature.

The control unit 101 starts this control process every 5 milliseconds, for example.

At Step S61, it is determined whether an image adjusting request is issued. The process ends when no image adjusting request is issued, while the system control proceeds to Step S62 when an image adjusting request is issued.

The image adjusting process is performed to detect changes in the condition of the imaging process due to changes in the temperature and humidity, and to optimize the process condition, thereby providing images steadily. Although not shown, when changes in the temperature and humidity are detected, the image adjusting request is issued.

At Step S62, it is determined whether the print enable signal to the controller 110 is ON. When the print enable signal is ON, the image adjusting process is performed at Step S63, and then the process ends.

When it is determined that the print enable signal is not ON, the process ends without doing anything.

In this way, the image adjusting operation is disabled while the printing is suspended.

Figure 9:
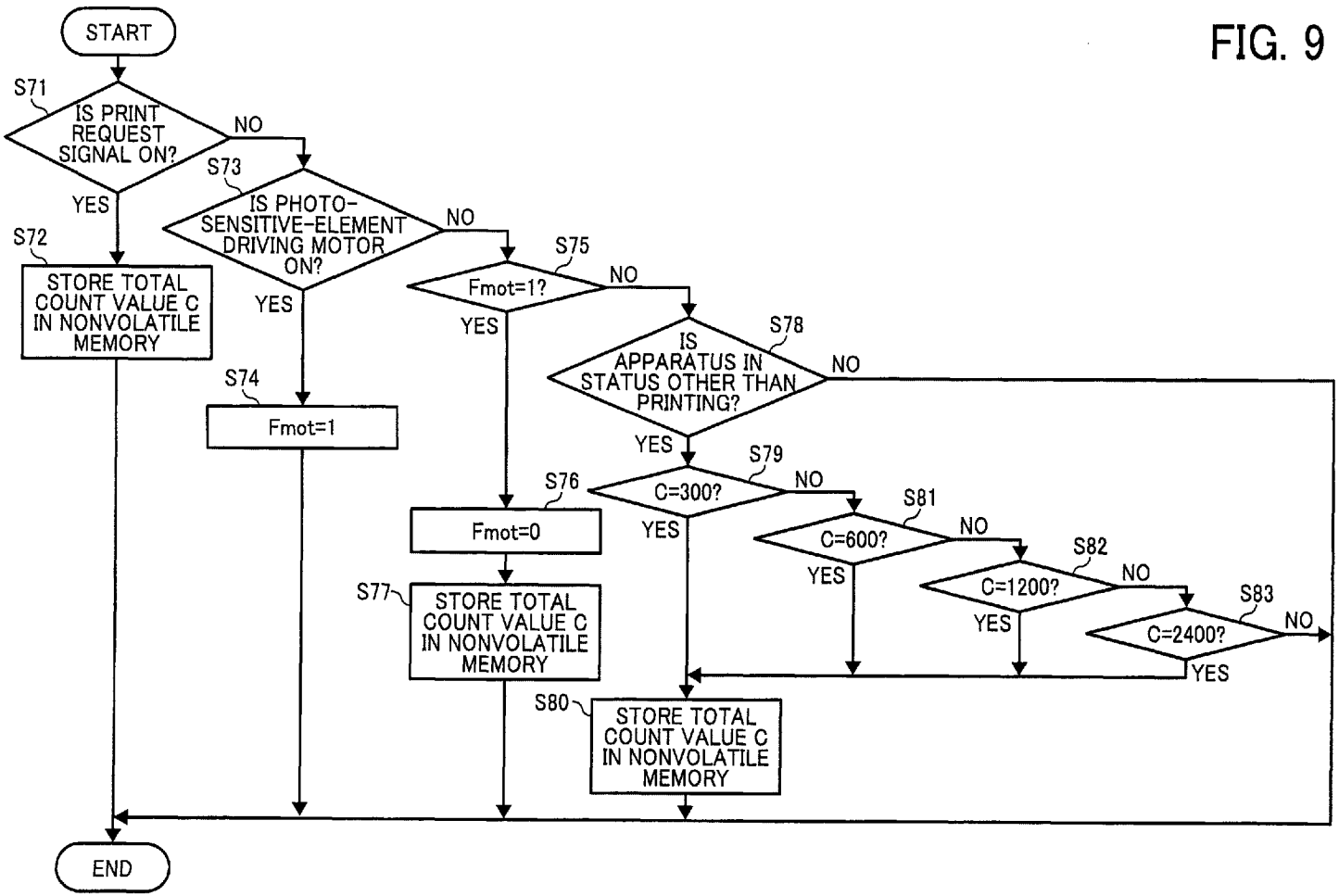
FIG. 9 is a flowchart of a control process for storing a total count value in a nonvolatile memory, performed by the image forming apparatus.
Figure 10:
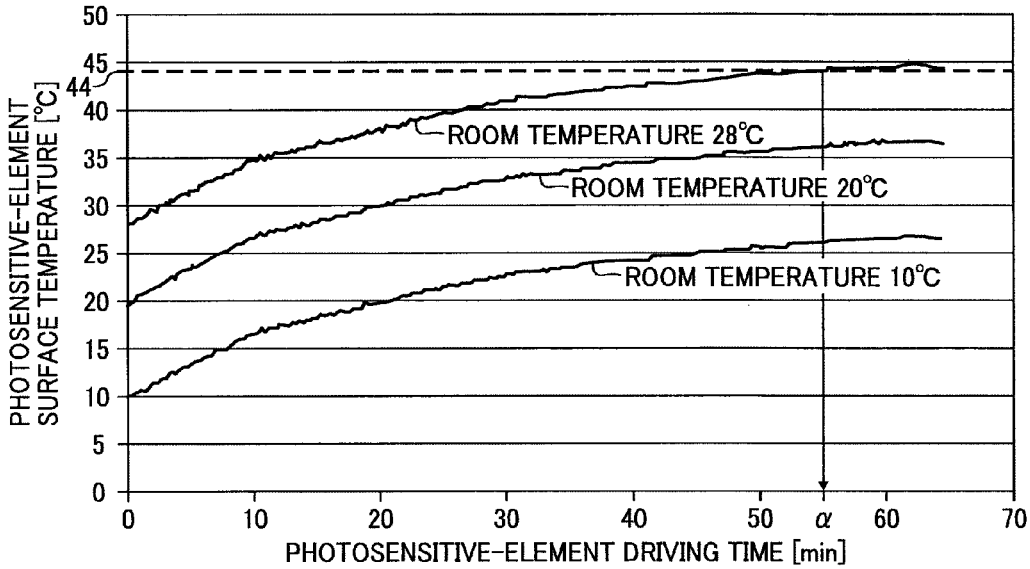
FIG. 10 is a graph representing a change in temperature of a photosensitive element surface in the image forming apparatus during printing.
Figure 11:
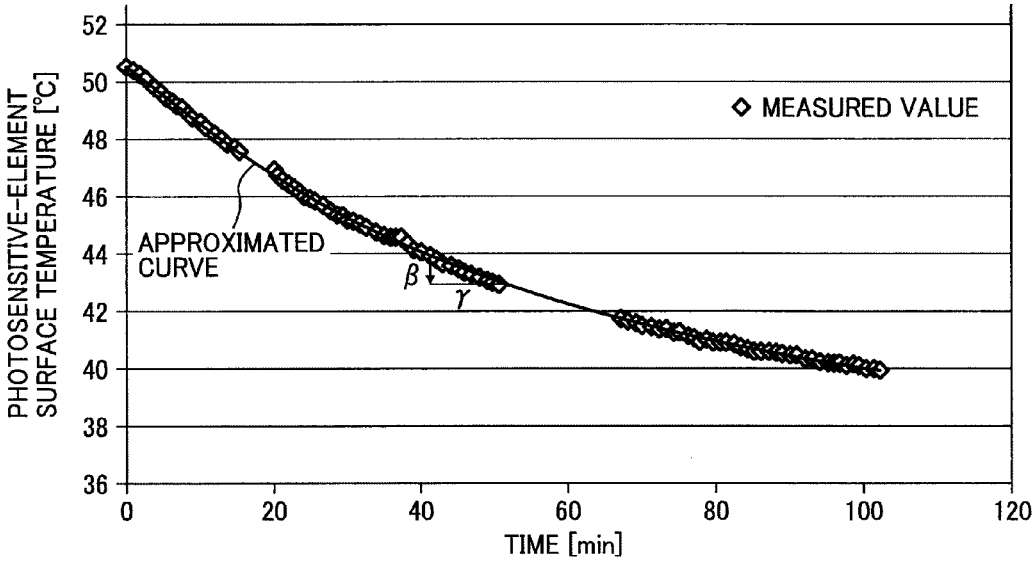
FIG. 11 is a graph representing a downward curve of temperatures of a photosensitive element surface while driving of photosensitive elements in the image forming apparatus is stopped.

FIG. 9 is a flowchart of a control process of storing the total count value C in the nonvolatile memory 106 in the image forming apparatus according to the present embodiment.

The control unit 101 starts this control process every second, for example.

At Step S71, it is determined whether the print request signal is ON. The system control proceeds to Step S72 when the print request signal is ON, while the system control proceeds to Step S73 when the print request signal is OFF.

At Step S72, the total count value C stored in the count-value storing unit 104 is written and stored in the nonvolatile memory 106, and then the process ends.

At Step S73, it is determined whether the photosensitive-element driving motor 111 is powered on. The system control proceeds to Step S74 when the photosensitive-element driving motor 111 is powered on, while the system control proceeds to Step S75 when the photosensitive-element driving motor 111 is powered off.

At Step S74, a photosensitive element-driving-motor ON flag Fmot indicating that the photosensitive-element driving motor 111 is operating is set at "1", and then the process ends.

At Step S75, it is determined whether the photosensitive element-driving-motor ON flag Fmot is one. When Fmot=1 (that is, the photosensitive element driving motor is operating), the system control proceeds to Step S76.

At Step S76, the photosensitive element-driving-motor ON flag Fmot is reset to "0", and then the system control proceeds to Step S77.

At Step S77, the total count value C stored in the count-value storing unit 104 is written and stored in the nonvolatile memory 106, and then the process ends.

At Step S78, it is determined whether the apparatus is now in a status other than a printing operation. When the apparatus is in a status other than a printing operation, the system control proceeds to Step S79. When the apparatus is in a printing operation, the process ends.

At Step S79, it is determined whether the total count value C stored in the count-value storing unit 104 is 300. The system control proceeds to Step S80 when the total count value C is 300, while the system control proceeds to Step S81 when the total count value C is not 300.

At Step S81, it is determined whether the total count value C stored in the count-value storing unit 104 is 600. The system control proceeds to Step S80 when the total count value C is 600, while the system control proceeds to Step S82 when the total count value C is not 600.

At Step S82, it is determined whether the total count value C stored in the count-value storing unit 104 is 1200. The system control proceeds to Step S80 when the total count value C is 1200, while the system control proceeds to Step S83 when the total count value C is not 1200.

At Step S83, it is determined whether the total count value C stored in the count-value storing unit 104 is 2400. The system control proceeds to Step S80 when the total count value C is 2400, while the process ends when the total count value C is not 2400.

At Step S80, the total count value C stored in the count-value storing unit 104 is written and stored in the nonvolatile memory 106, and then the process ends.

In this way, by performing the control process mentioned above, the image defect can be solved without a dedicated sensor.

The image forming apparatus according to the present embodiment suspends printing when the total count value C becomes equal to or larger than the predetermined value (C1). Therefore, printing that can cause a defect in images formed on the photosensitive element due to application of heat to the photosensitive element can be avoided without a temperature sensor that requires some costs.

To suspend printing during the continuous duplex printing, the printing is suspended after the recoding sheet remaining in the apparatus is removed. Therefore, the apparatus can be easily cooled down during the print suspension, thereby facilitating decrease in temperature of the photosensitive element surface.

The image adjusting operation is not performed while the printing is suspended, and thus the photosensitive element is not driven due to the image adjusting operation during the print suspension. Therefore, the photosensitive element surface can be easily cooled down, and a time period required to resume the print operation can be reduced.

At least one cooling unit that cools the apparatus is provided, and the at least one cooling unit is driven while the print is suspended. Therefore, the air flow in the apparatus can be improved, the photosensitive element surface can be promptly cooled down, and the time period required to resume the print operation can be reduced.

The count value (addition value) to be added during printing can be set at different values for the single-side printing and the duplex printing. In this way, timings of print suspension can be properly determined according to increased temperatures of the photosensitive element surface, which are different between the single-side printing and the duplex printing.

Furthermore, the count value (addition value) to be added during the printing can be set at different values for the time of printing and the time other than the time of printing. In this way, timings of print suspension can be properly determined according to increased temperatures of the photosensitive element surface, which are different for the time of printing and the time other than the time of printing.

The addition during printing is not performed when the total count value exceeds the predetermined upper limit. Therefore, a time period required from print suspension until print enabling (resuming) can be made constant.

The printing can be resumed when the total count value C becomes equal to or lower than the print enable threshold C2 (provided that the print disable threshold C1>C2) while the printing is suspended. Therefore, it is possible to provide a time interval between the print suspension and the print enabling (resuming).

The values to be subtracted from the total count value C can be set at different values for a case where the total count value C is equal to or higher than the print enable threshold C2 and a case where the total count value C is lower than the print enable threshold C2. In this way, the actual condition of the cooled (lowered) temperature of the photosensitive element surface can be represented in a simplified manner.

Because the nonvolatile memory is installed and the total count value is stored in the nonvolatile memory, the total count value stored in the nonvolatile memory can be used at the power-on even when the apparatus is powered off while the temperature of the photosensitive element surface is increasing. Accordingly, counting can be resumed from the total count value substantially corresponding to the actual temperature of the photosensitive element surface.

The timings when the total count value is stored in the nonvolatile memory can be changed between the time of printing and the time other than the time of printing. In this way, the total count value at the power off at the time of printing and at the time other than the time of printing can be securely stored, while the limited number of writings provided by the specifications of the nonvolatile memory is kept, thereby assuring the accuracy in the total count value.

The timings when the total count value is stored in the nonvolatile memory during printing can be set according to the number of copies. In this way, even when the apparatus is powered off during printing in which the temperature of the photosensitive element surface abruptly changes, the accuracy in the total count value can be assured.

The timing when the total count value is stored in the nonvolatile memory at the time other than the time of printing can be set at a time when the total count value reaches a predetermined value. In this way, the accuracy in the total count value obtained when the apparatus is powered off at a time other than the time of printing can be assured, while the limited number of writings provided by the specifications of the nonvolatile memory is kept.

The printing can be suspended according to results of the measurement by the external-temperature measuring unit that measures an external temperature. In this way, the printing can be suspended when the room temperature outside the apparatus is 28° C. or higher, for example.

It is also possible to measure the temperature of the surface of the fixing roller, read the total count value stored in the nonvolatile memory at the power on or at the return from the energy saving mode, subtract from the read total count value, an offset value corresponding to the temperature of the surface of the fixing roller (fixing temperature) measured at that time, and set a resultant value as a new total count value. In this way, even when the temperature of the photosensitive element surface is unknown like at the power on or at the return from the energy saving mode, an appropriate total count value can be set based on the fixing temperature and the total count value stored in the nonvolatile memory.

According to an aspect of the present invention, the image forming apparatus can avoid printing that may cause a defect in an image formed on an image carrier due to heat application to the image carrier at low cost and without a temperature sensor.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that forms an image on a recording medium by forming a latent image on an image carrier driven to rotate by a driving unit, developing the latent image into a toner image with toner, and fixing the toner image transferred onto the recording medium by a fixing unit, the image forming apparatus comprising:

a counting unit that, when the driving unit is driving the image carrier, adds a predetermined first count value to a total count value in a predetermined timing and that, when the driving unit is being stopped, subtracts a predetermined second count value from the total count value in every predetermined timing; and a suspending unit that suspends printing when the total count value becomes equal to or larger than a preset suspend value.

2. The image forming apparatus according to claim 1, further comprising:

a determining unit that determines, in a continuous duplex printing, whether a recording medium is left in the apparatus; and a discharging unit that discharges, when the determining unit determines that a recording medium is left in the apparatus, the recording medium before the suspending unit suspends the printing.

3. The image forming apparatus according to claim 1, further comprising:

an image adjustment disabling unit that disables an image adjusting operation while the suspending unit suspends the printing.

4. The image forming apparatus according to claim 1, further comprising:

a cooling unit that cools down the apparatus while the suspending unit suspends the printing.

5. The image forming apparatus according to claim 1, wherein the first count value is set at different values for a time of printing and a time other than the time of printing.

6. The image forming apparatus according to claim 5, wherein at the time of printing, the first count value is set at different values for a single-side printing and a duplex printing.

7. The image forming apparatus according to claim 1, wherein the counting unit controls the total count value not to exceed a predetermined upper limit.

8. The image forming apparatus according to claim 1, further comprising:

a resuming unit that resumes the printing when a count value obtained by subtracting the second count value from the total count value after the suspending unit suspends the printing becomes equal to or lower than a preset resume value.

9. The image forming apparatus according to claim 8, wherein the second count value is set at different values for a case where the total count value is higher than the resume value and a case where the total count value is equal to or lower than the resume value.

10. The image forming apparatus according to claim 1, further comprising:

a storing unit that stores the total count value in a nonvolatile memory.

11. The image forming apparatus according to claim 10, wherein the storing unit stores the total count value at different timings for a time of printing and a time other than the time of printing.

12. The image forming apparatus according to claim 11, wherein the timings are determined based on number of printed recording media.

13. The image forming apparatus according to claim 11, wherein the storing unit stores the total count value when the total count value reaches a predetermined value during the time other than the time of printing.

14. The image forming apparatus according to claim 10, further comprising:

a temperature measuring unit that measures a surface temperature of the fixing unit; and a reading unit that reads the total count value stored in the nonvolatile memory at power-on or at return from an energy saving mode, subtracts from the total count value an offset value corresponding to the surface temperature, and sets a resultant value as a new total count.

15. The image forming apparatus according to claim 1, further comprising:

a temperature measuring unit that measures an external temperature, wherein the suspending unit suspends the printing when the external temperature becomes equal to or higher than a preset temperature.

* * * * *